US006994527B2

(12) United States Patent
Strand et al.

(10) Patent No.: US 6,994,527 B2
(45) Date of Patent: Feb. 7, 2006

(54) PROCESS AND A DEVICE FOR TRANSPORT OF GAS

(75) Inventors: Odd Strand, Oslo (NO); Odd Bjarnø, Oslo (NO); Lars-Erik Johansson, Älmeboda (SE)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 10/481,750

(22) PCT Filed: Jun. 24, 2002

(86) PCT No.: PCT/NO02/00225

§ 371 (c)(1),
(2), (4) Date: Apr. 15, 2004

(87) PCT Pub. No.: WO03/001106

PCT Pub. Date: Jan. 3, 2003

(65) Prior Publication Data

US 2004/0161343 A1 Aug. 19, 2004

(30) Foreign Application Priority Data

Jun. 25, 2001 (NO) ..... 2001 3188

(51) Int. Cl.
*F04F 5/22* (2006.01)

(52) U.S. Cl. ..... 417/165

(58) Field of Classification Search ..... 417/151, 417/155, 163, 169, 174, 176, 179, 165
See application file for complete search history.

(56) References Cited

U.S. PATENT DOCUMENTS

| | | | | | |
|---|---|---|---|---|---|
| 250,073 | A | * | 11/1881 | Hudson | 417/174 |
| 486,162 | A | * | 11/1892 | Jones | 417/155 |
| 512,508 | A | * | 1/1894 | Gaul | 417/155 |
| 568,445 | A | * | 9/1896 | Kennedy | 417/165 |
| 1,152,302 | A | * | 8/1915 | Davenport | 417/163 |
| 2,033,843 | A | * | 3/1936 | McNulty | 417/165 |
| 2,211,795 | A | * | 8/1940 | Sauer | 417/174 |
| 4,934,407 | A | | 6/1990 | Andersson | |

* cited by examiner

*Primary Examiner*—Michael Koczo, Jr.
(74) *Attorney, Agent, or Firm*—Arthur E. Fournier, Jr.

(57) ABSTRACT

The present invention provides a process and a device for transport of gas in a main duct with more than two branch ducts wherein the gas is guided through the branch ducts (1, 2, 3, 4, 5, 6, 7, 8) and into the main duct (A) with a direction which is parallel to the direction of the flow in the main duct, while the gas in the branch duct at the inlet to the main duct is kept at a higher velocity than the gas in the main duct and the gas in the main duct is given an impulse, by utilisation of excess energy from the gas in the branch duct, for acceleration of the gas prior to introduction into the main duct.

10 Claims, 2 Drawing Sheets

PROCESS AND A DEVICE FOR TRANSPORT OF GAS

The present invention relates to a process for suction of gas from several points, and transport of the gas away from these points.

BACKGROUND OF THE INVENTION

In the process for electrolytic production of aluminium, such as by the Hall-Heroult process where aluminium is produced by reducing aluminium oxide in an electrolysis cell filled with melted electrolyte in the form of a fluoride-containing mineral to which aluminium oxide is supplied, the process gases comprises fluoride-containing substances such as hydrogen fluoride and fluorine containing dust. As these substances are extremely damaging to the environment, they have to be separated before the process gases can be discharged into the surrounding atmosphere. At the same time the fluorine-containing melt is essential to the electrolytic process, and it is desirable to recover the compounds for recirculation to the electrolysis. This recirculation may take place by adsorption of the fluorine-containing substances on a particulate adsorbent.

The system for recovery of the fluoride compounds comprises a filter system, which is included in a closed system. It is important to have stable transport of the gases from the aluminium production to the filter system. This transport is accomplished in gas ducts where the gases, by means of large fans, are conveyed through the gas ducts, comprising main ducts and branch ducts, to the filter system. For each aluminium production cell a branch duct is brought into the main duct, the cross section of the main duct increases gradually, by means of diffusers as the gas quantity increases. It is very important for the process as well as the environment that the gas distribution is as even as possible, and traditionally this is achieved by an increasingly stronger throttling of the gas in the branch duct the closer to the suction fans the branch duct is localised. Throttling represents sheer energy loss through a pressure drop. By the present invention, this pressure drop is substantially reduced, contributing to a reduced total pressure drop in the system. The total pressure drop in the duct system is measured from the first suction point. The invention may equally well be applied for gas ducts where there is a need for a different, but controlled, gas quantity from each suction point.

Previously it is known within the aluminium industry to bring the branch ducts with an angle of 30–90° into the main duct. The angular deviation causes slip and turbulence in the zone after the introduction of the gas. Previously it is also known to convey the gas through the branch duct with a velocity lower than the velocity in the main duct. This implies that the gas in the main duct must accelerate the gas from the branch duct. Thus the angular deviation, and the difference in the velocity causes an increased resistance in the main duct.

The duct system contributes to approximately 50% of the total pressure drop in the system for recovery of fluorides, this implies that a reduction in the pressure drop here will result in a considerably reduced operational cost for the plant and this gives the basis for the present invention. The aluminium industry is applied as an example, however, this is also a preferred field.

From SE 466 837 it is known branch ducts where the gas is guided into the main duct in parallel with the gas flow in the main duct. However, in said patent it is important that the velocity of the gas in the main duct and in the branch duct are principally the same, so that there is a low resistance both in the main duct and the branch duct.

It has now been found that a considerable reduction of the pressure drop in the gas duct, and consequently the energy consumption for the gas transport, may be achieved by carrying out the introduction of the gas from the branch duct in a new manner. The gas is guided, as in SE 466 837 into the main duct with a flow direction parallel to the flow of gas in the main duct. Through the first part of the branch duct, the velocity of the gas is lower than in the main duct. When the direction of the gas flow has been adjusted, being parallel with the direction of the gas flow in the main duct, the cross section is narrowed before the outlet of the branch duct by means of an nozzle, so that the gas is accelerated and the gas introduced into the main duct at a velocity higher than in the main duct. By this procedure, the pressure drop in the main duct, and the total energy requirement for the gas transport is considerably reduced. An even suction from each electrolysis cell is assured by adjusting the nozzle of the branch duct, which might be equipped with an adjustable flap. The examples being described relates to transport of process gases within the aluminum industry, but it is obvious for the person skilled in the art, that the same system for transport of gas may be utilised within all fields where there is a need for transport of gas from several points, e.g. other metallurgical industry, suction in laboratories, ventilation systems, etc. Further it is obvious for the person skilled in the art that the invention may be utilised also where there is need for gas transport with different but controlled gas quantities from each point of suction along a long duct.

BRIEF SUMMARY OF THE INVENTION

According to the invention, a process has been developed for bringing a branch duct for transport of gas together with a main duct so that a considerable (10–90%) reduction in the pressure drop related to the transport of the gas is achieved. The gas is guided through the first part of the branch duct with a velocity lower than in the main duct. Prior to introduction to the main duct the direction of the gas flow through the branch duct is adjusted if necessary, so that this by the introduction into the main duct is parallel to the flow of gas in the main duct. Prior to the introduction of the gas into the main duct, the cross section of the branch duct is reduced, and the gas is accelerated to a velocity 10–100% higher than the velocity of the gas in the main duct. Hereby a positive impulse for the gas in the main duct is achieved. With this process, the pressure drop related to the gas transport is considerably reduced, with corresponding cost savings.

BRIEF DESCRIPTION OF THE SEVERAL VIEWS OF THE DRAWINGS

The figures show example sketches which should not be considered as limiting for the invention.

DETAILED DESRIPTION OF THE INVENTION

Figure 1:
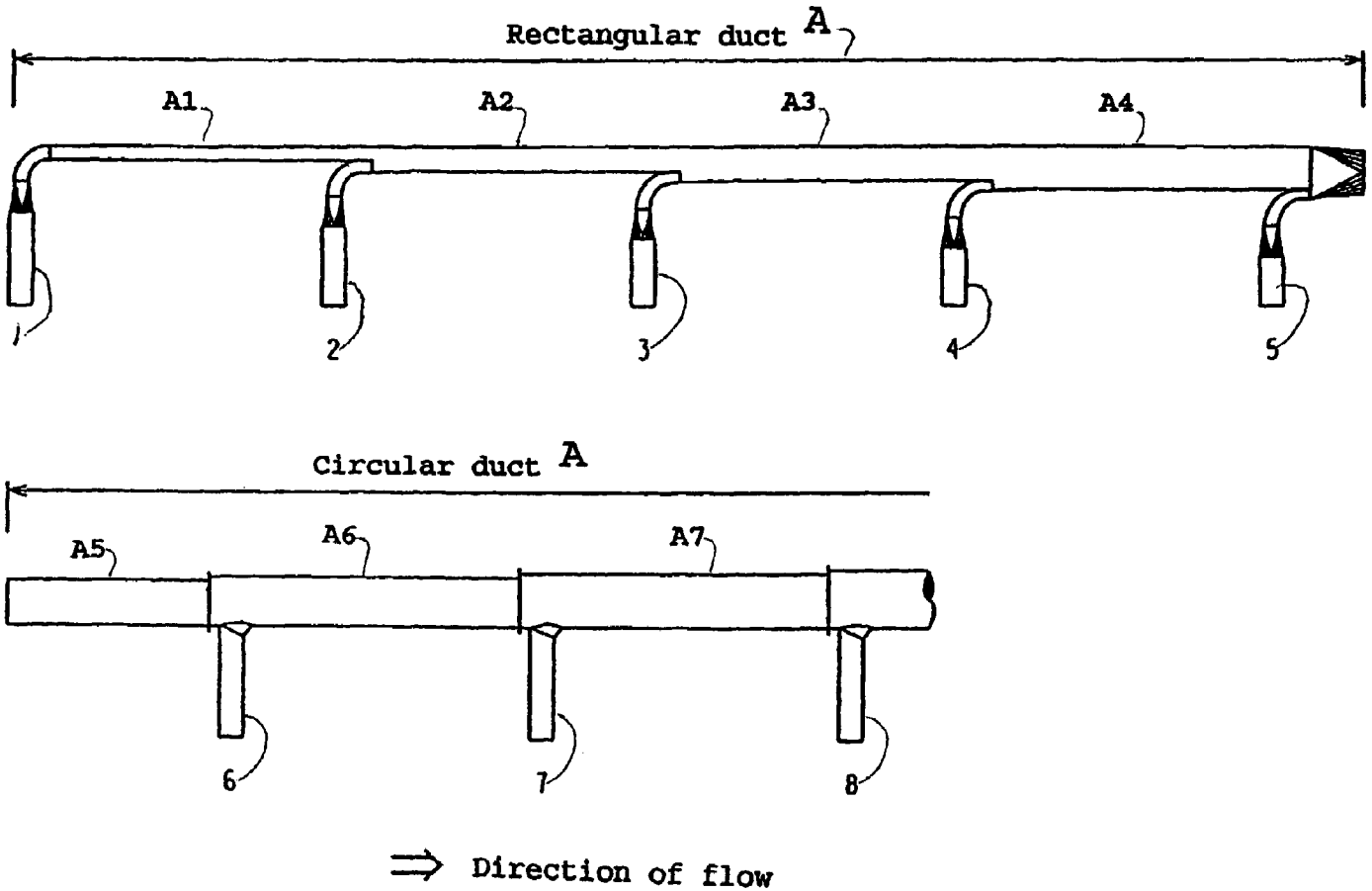
FIG. 1 shows a planar view of the main duct (A) with branch ducts 1, 2, 3, 3, 5, 6, 7, 8 seen from above. For a better illustration, the duct is split between the branch ducts 5 and 6, but in practice, these are continuous.
Figure 2:
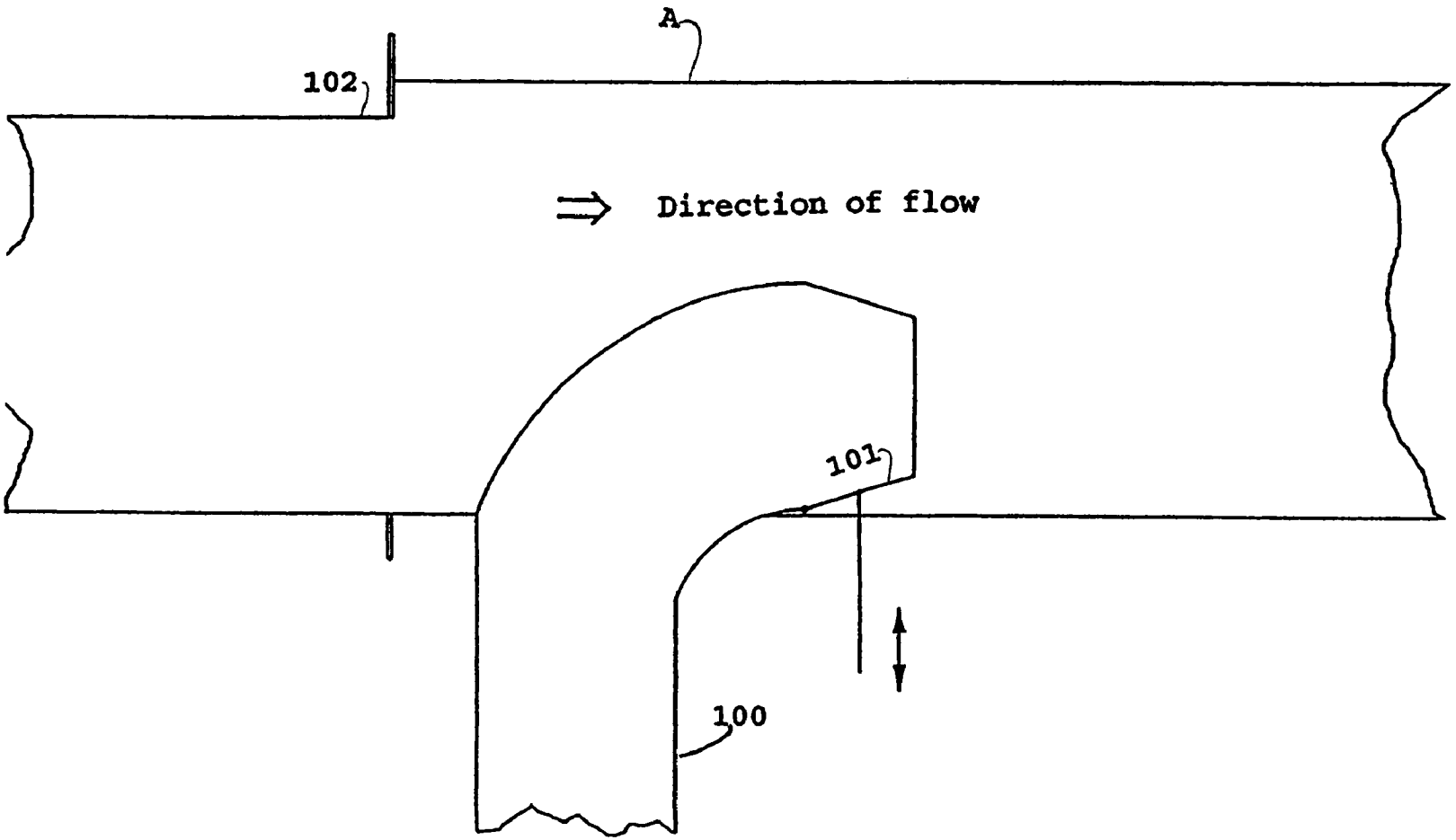
FIG. 2 shows a detail related to the introduction of a branch duct 100 in the main duct A seen from above.

According to the invention a process has been developed in order to bring the branch ducts 1, 2, 3, 4, 5, 6, 7, 8 into and together with a min duct A for gas transport in order to achieve a considerable (10–90%) reduction in the pressure drop in connection with the gas transport.

The power consumption in connection with the gas transport is proportional to the total transported gas quantity from all the branch ducts and the resistance to be overcome during the transport, i.e. the pressure drop across the transport distance from the first point of suction:

$$P=\Delta P_{Tot}*Q \quad \text{(I)}$$

wherein

P is the power, in W $\Delta P_{Tot}$ is the pressure drop across the transport distance, in Pa Q is the transported gas quantity, in $m^3/s$.

With a given gas quantity the only possibility for reducing the energy requirement is to reduce the resistance during the transport.

By following the procedure of the present invention, $\Delta P_{Tot}$ may be considerably reduced, preferably at least 30%, most preferably at least 60%.

A preferred embodiment relates specifically to production of aluminium, the process may however be applied in any venting, e.g. industrial ventings in metallurgical industry, venting in lab, venting for removal of dust/fumes, ventilation systems, etc. When applied within these areas, the embodiment may comprise 2 or more branch ducts, preferably at least 5 branch ducts.

In the preferred, but not limiting process, there is a line of aluminium production cells, typically 5–40 aluminium production cells on the line, but substantially more is also possible with the present invention, as the additional resistance for further aluminium production cells is insignificant. From each cell there is provided one or more branch ducts 1, 2, 3, 4, 5, 6, 7, 8 for suction of the process gases, and these branch ducts are connected to the main duct A. For the first 5 branch ducts 1, 2, 3, 4, 5 both the main duct and the branch ducts are rectangular ducts, while for the other branch ducts both the main duct and the branch ducts are circular ducts. During the first 5 branch ducts, the gas velocity in the main duct is successively increased to the final velocity in the main duct ($v_g$).

At the first cell the main duct comprises only the branch duct (1), which is adjusted to the desired flow direction. The gas velocity in the first part of the main duct A1 is lower than $v_g$, preferably at least 10% lower than $v_g$, more preferably at least 20% lower than $v_g$, typically at least 25% lower than $v_g$. During the first branch ducts the gas velocity in the main duct is increased, until it gradually gets equal to $v_g$.

Branch duct number 2 is bent to an angle which is necessary to be brought in parallel into and together with the main duct A by keeping the height of the main duct constant, while at the same time increasing the width. The branch duct is brought further on the inside of the duct, and is there additionally bent, so that the direction of the gas flow exiting the branch duct is parallel to the direction of the flow in the main duct. After the pipe bend, the cross section of the branch duct is reduced, e.g. by adjusting an adjustable flap 101 in the nozzle of the branch duct, and the gas achieves a velocity higher than the velocity in the main duct at the same point, preferably at least 2% higher, more preferably at least 5% higher, most preferably at least 7% higher, typically 10–20% higher than the velocity in the main duct at the same point.

Branch duct number 3–5 is designed essentially as branch duct number 2, however the cross section is further reduced in order to achieve a greater acceleration.

From branch duct number 6 and further 6, 7, 8, the branch ducts are in principle identical, and the gas velocity in the main duct is at the desired level; $v_g$. The increase in the cross section in the main duct takes place by an increased cross section 102 prior to the introduction of the branch duct in order to keep the gas velocity in the main duct equal to $v_g$ after the branch duct, while the branch duct 100 just is brought into the main duct A. The branch duct 100 is bent an angle 0–45° prior to being brought into the main duct A, where the design of the branch duct provides the remaining adjustment of the gas flow. When the gas exits from the branch duct, the gas velocity is higher than $v_g$, typically 10–100% higher than $v_g$.

It is further anticipated that the process may be applied for all areas of application where transport of gas from several points is necessary, without describing these areas specifically.

What is claimed is:

1. A process for transport of gas in a main duct with more than two branch ducts, each one of the more than two branch ducts having a nozzle, wherein a) the gas is brought through the more than two branch ducts and from the more than two branch ducts into the main duct in a flow direction parallel to the flow direction of the gas in the main duct;

b) the gas in each one of the more than two branch ducts is, at the inlet to the main duct from the more than two branch ducts, kept at a higher velocity than the gas in the main duct;

c) the gas in the main duct is given an impulse by utilization of excess energy from the gas in each one of the more than two branch ducts for acceleration of the gas from each one of the more than two branch ducts prior to the introduction of the gas from each one of the more than two branch ducts into the main duct; and d) the gas velocity in each one of the more than two branch ducts is adjustable by adjusting the position of a flap in the nozzle in each one of the more than two branch ducts.

2. The process of claim 1 wherein the gas velocity exiting from each one of the more than two branch ducts is kept 10–100% higher than the gas velocity in the main duct.

3. The process of claim 2 wherein the gas velocity in each one of the more than two branch ducts is kept lower than the gas velocity in the main duct.

4. The process of claim 3 wherein the gas velocity in each one of the more than two branch ducts is kept 10–50% lower than the gas velocity in the main duct.

5. The process of claim 1 wherein the gas in the main duct is gradually increased to the desired gas velocity after the introduction into the main duct of the gas from each one of the more than two branch ducts.

6. The process of claim 1 wherein the gas velocity of the gas that is introduced into the main duct from each one of the more than two branch ducts is increased prior to the introduction of the gas into the main duct from each succeeding one of the more than two branch ducts.

7. A process for transport of gas in a main duct with more than two branch ducts wherein a) the gas is brought through the more than two branch ducts and from the more than two branch ducts into the main duct in a flow direction parallel to the flow direction of the gas in the main duct;

b) the gas in each one of the more than two branch ducts is, at the inlet to the main duct from the more than two branch ducts, kept at a higher velocity than the gas in the main duct;

c) the gas in the main duct is given an impulse by utilization of excess energy from the gas in each one of the more than two branch ducts for acceleration of the gas from each one of the more than two branch ducts prior to the introduction of the gas from each one of the more than two branch ducts into the main duct; and d) the gas velocity in each one of the more than two branch ducts is adjustable by throttling.

8. A device for transport of gas in a main duct with more than two branch ducts, each one of the more than two branch ducts having an inlet and an outlet, wherein a) the more than two branch ducts has a flow of gas therethrough and a flow of gas is provided from the more than two branch ducts into the main duct in a flow direction parallel to the flow direction of the gas in the main duct;

b) each one of the more than two branch ducts is provided with a reduction in the cross-section thereof adjacent the outlet thereof in the form of an adjustable flap for adjusting by means of the adjustable flap the velocity of the gas in each one of the more than two branch ducts; and c) each one of the more than two branch ducts introduces the gas from each one of the more than two branch ducts into the main duct such that the gas introduced into the main duct from each one of the more than two branch ducts provides an impulse to the gas in the main duct by utilization of excess energy from the gas from each one of the more than two branch ducts from the acceleration of the gas in each one of the more than two branch ducts prior to the introduction into the main duct of the gas from each one of the more than two branch ducts.

9. The device of claim 8 wherein the gas in the main duct is gradually increased to the desired gas velocity after the introduction into the main duct of the gas from each one of the more than two branch ducts.

10. The device of claim 8 wherein the gas velocity of the gas that is introduced into the main duct from each one of the more than two branch ducts is increased prior to the introduction of the gas into the main duct from each succeeding one of the more than two branch ducts.

* * * * *